US006230524B1

(12) United States Patent
Kolmes et al.

(10) Patent No.: US 6,230,524 B1
(45) Date of Patent: May 15, 2001

(54) COMPOSITE YARN HAVING FUSIBLE CONSTITUENT FOR MAKING RAVEL-RESISTANT KNIT ARTICLE AND KNIT ARTICLE HAVING RAVEL-RESISTANT EDGE PORTION

(75) Inventors: Nathaniel H. Kolmes; Danny Ray Benfield; Della Bonnell Moore, all of Hickory; George Marion Morman, Jr., Moravian Falls; Richie Darnell Phillips; Eric Pritchard, both of Hickory, all of NC (US)

(73) Assignee: Supreme Elastic Corporation, Conover, NC (US)

( * ) Notice: Subject to any disclaimer, the term of this patent is extended or adjusted under 35 U.S.C. 154(b) by 0 days.

(21) Appl. No.: 09/370,117

(22) Filed: Aug. 6, 1999

(51) Int. Cl.[7] ..... D04B 9/58

(52) U.S. Cl. ..... 66/172 R; 66/174; 66/202; 57/210; 57/230

(58) Field of Search ..... 66/159, 169 R, 66/174, 172 R, 172 E, 65, 170, 171, 190, 202; 57/210, 224, 230, 231, 235

(56) References Cited

U.S. PATENT DOCUMENTS

| | | | | |
|---|---|---|---|---|
| 1,766,776 | | 6/1930 | Chisholm . | |
| 2,076,273 | | 4/1937 | Harris | 117/35 |
| 2,281,647 | | 5/1942 | Whitehead | 57/140 |
| 2,588,361 | | 3/1952 | Cooper | 57/152 |
| 3,460,338 | | 8/1969 | Morrison | 57/163 |
| 3,487,628 | | 1/1970 | Csok | 57/152 |
| 3,669,046 | | 6/1972 | Fowler | 112/121.15 |
| 3,828,544 | | 8/1974 | Alker | 57/152 |
| 3,901,289 | | 8/1975 | Filter et al. | 139/291 |
| 4,016,714 | * | 4/1977 | Crandall et al. | 57/234 |
| 4,191,221 | | 3/1980 | Boyer | 139/426 |
| 4,299,884 | | 11/1981 | Payen | 428/377 |
| 4,644,741 | | 2/1987 | Gradinger et al. | 57/256 |
| 4,750,339 | * | 6/1988 | Simpson, Jr. et al. | 66/172 R |
| 4,777,789 | | 10/1988 | Kolmes et al. | 57/210 |
| 4,838,017 | | 6/1989 | Kolmes et al. | 57/210 |
| 4,991,387 | | 2/1991 | Tashiro et al. | 57/256 |
| 5,010,723 | | 4/1991 | Wilen | 57/210 |
| 5,085,917 | | 2/1992 | Hodnett, III | 428/173 |
| 5,178,630 | | 1/1993 | Schmitt | 623/1 |
| 5,239,846 | * | 8/1993 | Kitaura et al. | 66/174 |
| 5,403,644 | | 4/1995 | Fujisawa et al. | 428/137 |
| 5,416,961 | * | 5/1995 | Vinay | 28/165 |
| 5,417,048 | | 5/1995 | Thomas | 57/256 |
| 5,456,096 | | 10/1995 | Mitsumoto et al. | 66/69 |
| 5,572,860 | | 11/1996 | Mitsumoto et al. | 57/224 |
| 5,749,212 | | 5/1998 | Rees et al. | 57/225 |
| 5,771,673 | * | 6/1998 | Lorch | 57/234 |

* cited by examiner

*Primary Examiner*—Danny Worrell
(74) *Attorney, Agent, or Firm*—Rhodes & Mason, P.L.L.C.

(57) ABSTRACT

A knit article having an edge portion subject to raveling with the article including plurality of knitting courses in said edge portion. Each of the edge portion knitting courses is knitted with a composite heat fusible yarn comprising a core including at least one low melt core strand and at least one cover strand wrapped around the core in a first direction. The cover strand is wrapped around the core at a rate suitable to partially cover the core while leaving exposed a sufficient amount of the core to facilitate a bond to an adjacent yarn strand in a knit structure upon application of heat to the core.

23 Claims, 1 Drawing Sheet

COMPOSITE YARN HAVING FUSIBLE CONSTITUENT FOR MAKING RAVEL-RESISTANT KNIT ARTICLE AND KNIT ARTICLE HAVING RAVEL-RESISTANT EDGE PORTION

BACKGROUND OF THE INVENTION (1) Field of the Invention

The present invention relates to the field of making knit articles, and, more particularly, to preventing the raveling of an edge portion of a knit article such as a knit glove.

(2) Description of the Prior Art

Knitting processes have been used to make a variety of products and garments for quite some time. This textile fabrication technique creates comfortable items that are pliable, have high extensibility and that are relatively inexpensive. Generally, knitting provides productivity and lead time advantages compared to weaving processes. Knitting machinery is better adapted to producing small lots of goods and provides a shorter lead time and quicker response to such orders. In many respects knitting processes are faster than wovens and offer the benefits of providing body sizes and full-fashioned garments. Other knitting advantages include the low initial capital costs, the lack of a need for expensive yarn preparation, the small area of floor space required for the equipment and the need for fewer auxiliary machines during operation. Knitting processes have been carried out in the textile art with a wide range of natural and synthetic yarns.

Despite all these advantages, a knit garment or article, and in particular a knit glove, suffers from a drawback. Knit products are susceptible to raveling. Raveling is defined technically as the process of undoing or separating the knit of a fabric. The term also refers to the process of removing yarns consecutively from a fabric and, further, to a loose yarn that has been partially or wholly detached from a cloth. As a practical matter, it is known that a loose end extending from a knit product may be pulled and, under the right circumstances, an entire knit item may be pulled apart simply by pulling on the loose end.

For glove makers, this problem has been particularly troublesome. One approach for dealing with the problem involves an extra sewing step. After knitting, the edge portions of knit glove cuffs are sewn manually on serging machines to apply an overlock stitch designed to hold any loose ends of material in place. This overcast sewing typically is accomplished with a polyester, nylon or cotton yarn. It will be readily appreciated that the additional serging step is labor intensive and can add significantly to the manufacturing cost of the glove.

Another approach for addressing this problem involves the use of a fusible adhesive yarn of the type disclosed in U.S. Pat. No. 5,572,860 to Mitsumoto, et al. In the Mitsumoto yarn a spun core yarn having an elastic component and a heat fusible multi filament yarn strand are twisted with each other in the same or opposite twisting directions. The spun core yarn is itself composed of an elastic yarn and a non-elastic short fiber assembly spun together in the direction of the elastic yarn. The non-elastic short fiber assembly encloses the circumference of the elastic yarn as a core. The non-elastic short fiber assembly is expanded and bent by the contraction of the elastic yarn. The fusible adhesive yarn is either introduced in the spinning operation or wrapped around the spun core. As a result the low melt attached to the short fibers upon thermal setting, the adhesive yarn is solidified into small blocks located in a form of dots such that the expanded short fibers cover the small blocks of solidified fusible adhesive yarn.

In commercial applications it is believed that the yarn described in the Mitsumoto, et al. patent typically has been produced using the combination of spandex, polyester and a low melt yarn. This combination produced favorable results with respect to eliminating the additional labor associated with the sewn-in yarn described above. Nevertheless, this yarn has a unique set of drawbacks. First, the need for three components in the yarn makes it a relatively high cost solution. The tension in the elastic component of the spun core yarn must be carefully controlled so as to produce just the right amount of expansion and opening of the short fiber assembly. The spandex component is provided with a silicone finish, which, even in minute quantities, can contaminate particular types of work areas. For example, controlled environment chambers used for automobile painting are particularly sensitive to silicone contamination arising from the spandex finish. Lastly, experience with fusible adhesive yarns of this type has shown that, after repeated washings, the internal bond created by the fusible yarn breaks down.

Another type of commercially available heat fusible yarn is comprised of an elastic core strand, one or more wrap strands of a non-elastic material such as textured polyester and a cover strand comprised of a heat fusible yarn. The heat fusible yarn is placed on the outside of the composite yarn structure so as to be in intimate contact with and more readily bond to adjacent yarn strands. A typical heat fusible yarn of this type is available from Supreme Corporation as style number 343. This yarn provides acceptable results but does require a two-step manufacturing process given the separate wrapping steps needed.

There are other considerations for including a heat fusible yarn in the edge portion of a knit article subject to raveling. The yarn employed for this purpose must have sufficient fiber structure cohesiveness to knit properly in automated knitting equipment. That is, if a multifilament yarn is used, the individual filament strands should not flare or be too loose for proper knitting equipment performance. For this reason, it may not be desirable to feed the fusible yarn alone into the last several courses of the edge portion of the item being knit.

It has been found that knitting the low melt fusible yarn side by side with another yarn does not address these problems. The exposure of the low melt fusible fibers to adjacent fibers in the yarn structure may be inconsistent leading to uneven bonding and unsatisfactory ravel prevention performance.

Lastly, it has been found that problems may be encountered with the cutting operation that separates the glove from the knitting machine at the end of the glove knitting cycle. The machine integrated cutting mechanism may not function properly if a very open yarn is used in the last several courses of the glove.

It follows that there is a need for a knit article incorporating a heat fusible composite yarn so as to address the raveling problems in the edge portion of knit products. The article and yarn should use readily available, low-cost components and manufacturing techniques and should be capable of being heat treated using existing equipment to prevent raveling of the edge portion of the article.

SUMMARY OF THE INVENTION

The present invention addresses the raveling problems in the edge portions of knit articles, particularly knit gloves, by providing a knit article incorporating a novel heat fusible yarn in the courses making up the edge portion of the article. A knit article made according to the present invention may have its edge portion or portions heat treated using existing equipment. The novel heat fusible yarn incorporated into the knit article is constructed of a composite yarn having a low melt core strand covered with one or more high melt cover strands.

The present invention relates to a knit article having an edge portion subject to raveling, the article, comprising a plurality of knitting courses in the edge portion; wherein each of the edge portion knitting courses is knitted with a composite heat fusible yarn. The heat fusible yarn comprises a core including at least one low melt core strand and at least one cover strand wrapped around the core in a first direction. The cover strand is wrapped around the core at a rate suitable to partially cover the core while leaving exposed a sufficient amount of the core to facilitate a bond to an adjacent yarn strand in a knit structure upon application of heat to the core. In a preferred embodiment the knit article is a glove and the composite heat fusible yarn is knitted into the cuff portion of the glove.

The present invention further relates to a heat fusible composite yarn comprising a low melt core comprising at least one low melt core strand; and at least one cover strand wrapped around the core in a first direction. The cover strand is wrapped around the core strand at a rate suitable to partially cover the core while leaving exposed a sufficient amount of the core to facilitate a bond to an adjacent yarn strand in a knit structure upon application of heat to the core.

In a preferred embodiment the low melt core yarn is comprised of a material selected from the group consisting of polyethylene, polyethylene copolymers such as ethylene vinyl acetate, polyamide and polypropylene.

In a particularly preferred embodiment, the knit article is a glove and the heat fusible yarn is knitted in a cuff portion of the glove.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE PREFERRED EMBODIMENT

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

The term "filament" as used herein refers to a strand of indefinite or extreme length such as found naturally in silk. This term also refers to manufactured strand produced by, among other things, extrusion processes. Individual filaments making up a yarn strand may have any one of a variety of cross sections to include round, serrated or crenular, bean-shaped or others.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consist of a single strand.

Figure 1:
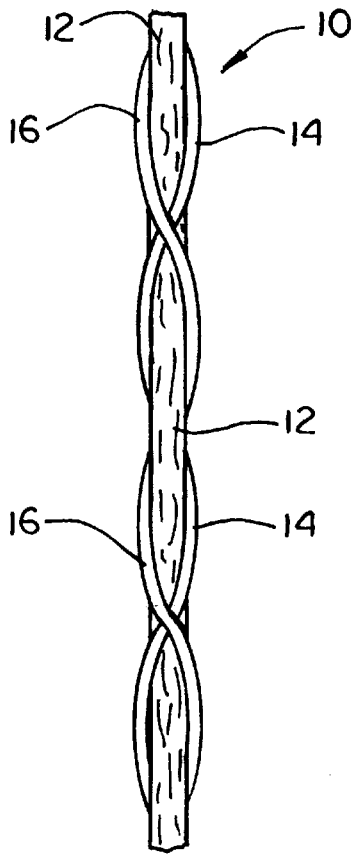
FIG. 1 is a schematic illustration of a multi-strand composite yarn used in the practice of the present invention.

The heat fusible yarn of the present invention is indicated generally at 10 in FIG. 1. In this preferred embodiment, the heat fusible yarn includes at least one low melt multifilament core strand 12 and at least one cover strand 14 wrapped thereabout. For the purposes of providing a balanced yarn and to improve knitting performance, the yarn preferably is provided with an additional cover strand 16 wrapped in a direction opposite that of the first cover strand 14. The cover strands are wrapped about the core strand at a rate that will expose a sufficient amount of the low melt core strand 10 to facilitate a bond to an adjacent yarn strand in a knit structure. This suitable rate will be readily ascertainable if it is understood that at very high wrapping rates the wrapping strand or strands will completely cover the underlying strand. Accordingly, a desirable wrapping rate is one that only partially covers the low melt core strand 10 while leaving exposed a sufficient amount of that strand to facilitate a bond to an adjacent yarn strand in a knit structure upon application of heat to the core strand. Typically, the low melt core strand should be visually discernable from the wrap strands. Desirably, the cover strand or, if used, multiple cover strands are wrapped about the low melt core strand 10 at a rate of up to about 20 turns per inch. In a preferred embodiment the wrapping rate is between about 3 and about 10 turns per inch. More preferably, a wrapping rate of about 5 turns per inch is used. Other lower wrapping rates may be used depending on the denier and the nature of the material selected to make up the composite yarn. For example, if the low melt core strand has a smaller diameter, then a lower wrapping rate should be used. Conversely, if the low melt core strand has a large diameter then a higher wrapping rate using a smaller diameter cover strand or strands may be suitable. The determination of a proper wrapping rate can be made by an evaluation of the composite yarn bonding performance after being heat set.

As used herein, the term "low melt" refers to a yarn strand constructed of a material having a melting point that allows it to be used on commercial heat setting equipment to bond to and hold other yarn strands in a knit fabric structure in place. Various examples of such materials are known in the art. Preferably, the yarn will have a melting point of between about 175° F.–285° F. More preferably, the low melt yarn has a melting temperature between about 200° F.–225° F.

Desirably, the low melt yarn is comprised of polyethylene, a polyethylene copolymer such as a copolymer of ethylene and vinyl acetate or another thermoplastic material such as polypropylene. One suitable ethylene copolymer is available from the Korean company Tae Young. Another suitable copolymer of ethylene and vinyl acetate is available from Fiber Science, Inc. of Palm Bay, Fla. as product 0501-200/12. Another suitable low melt yarn material is polyamide such as that available under the trademark FLOR from Unitika or ELDER available from Toray Industrial, Inc. Desirably, each of the aforementioned materials is provided in multifilament form. The low melt yarn need not be comprised entirely of fusible material such that the entire yarn strand would melt. For example, the low melt yarn could be comprised of a high melt core and a low melt sheath. The low melt sheath may be applied using a coextrusion process. Alternatively, the low melt yarn may be a multifilament construction made of some low melt strands and some non-low melt strands. Either of the options just discussed is acceptable so long as a sufficient amount of the low melt constituent is available for bonding to adjacent strands in a knit structure during heat setting.

The low melt core may be provided in one of a variety of commercially available sizes depending on the end use of the knit article being constructed. Desirably, the strand may have an overall denier of between about 50 and about 300. More preferably, the strand may have an overall denier between about 175 and about 250. The term "overall denier" refers to the denier of a single strand or the combined denier of two or more strands. Again, other overall denier sizes may be used depending on a number of factors to include, but not limited to, the knitting equipment that will be employed and the end use of the knit article.

The cover strand or strands may be comprised of any suitable natural or synthetic material suitable for use in a knitting operation. Suitable materials include nylon, polyester, polyester-cotton blends, cotton, wool and acrylic. The strands may be either spun or textured. Other materials may be used so long as they are compatible with the selected low melt yarn and the final application of the knitted item whose edge portion will be protected from raveling. The denier of the additional strand or strands will vary depending on the equipment available and the desired final size of the composite yarn.

Table 1 below illustrates representative combinations of low melt strands and additional strands that may be used in the practice of the present invention. In each of Examples 1–3 below the low melt yarn was the Fiber Science product described above provided in a multifilament form. The cover strands were provided in multifilament, textured form. A single core strand was used in each of the examples.

TABLE 1

| Exp | Low Melt Core | 1st Cover Strand | 2nd Cover Strand | Cover Strands tpi | Approx. Overall Denier |
|---|---|---|---|---|---|
| 1 | 200 denier | 70 den polyester | 70 den polyester | 5.5 | 380 |
| 2 | 250 denier | 70 den polyester | 70 den polyester | 5.4 | 437 |
| 3 | 250 denier | 150 den Polyester | 150 den Polyester | 4.8 | 661 |

Although each of the examples shown above includes a single strand core and two cover strands, the practice of the present invention includes providing multiple core strands and/or a single cover strand. Multiple core strands may be used if a desired denier cannot be achieved using a commercially available single strand thus permitting the size and characteristics of the composite yarn to be customized. Moreover, using multiple strands may permit the yarn manufacturer to use yarn stock on hand to create an acceptable product. Each of the examples described in Table 1 above was created using a cover strand wrapping rate of about 5 turns per inch. However, as discussed above, other wrapping rates may be used depending on the amount of exposure of the low melt yarn that is desired. It will be readily appreciated that, generally, decreasing the wrapping rate of the cover strand or strands increases the potential bonding power of the heat fusible composite yarn. The selection of a wrapping rate may be varied and is within the ability of one of ordinary skill.

Table 2 below illustrates additional prophetic examples of yarns that may be created according to the present invention

TABLE 2

| Exp | Low Melt Core | 1st Cover Strand | 2nd Cover Strand | Cover Strand Tpi | Approx. Overall Denier |
|---|---|---|---|---|---|
| 4 | 200 | 100 denier Polyester | 100 denier Polyester | 5.4 | 460 |
| 5 | 250 | 100 denier Polyester | 100 denier Polyester | 5.8 | 522 |
| 6 | 200 | 150 denier Polyester | 150 denier Polyester | 5.4 | 566 |

It will be appreciated that if cotton or some other spun fiber is used as a cover strand, that fiber will be provided in a size ranging from about 6 singles to about 36 singles.

Figure 2:
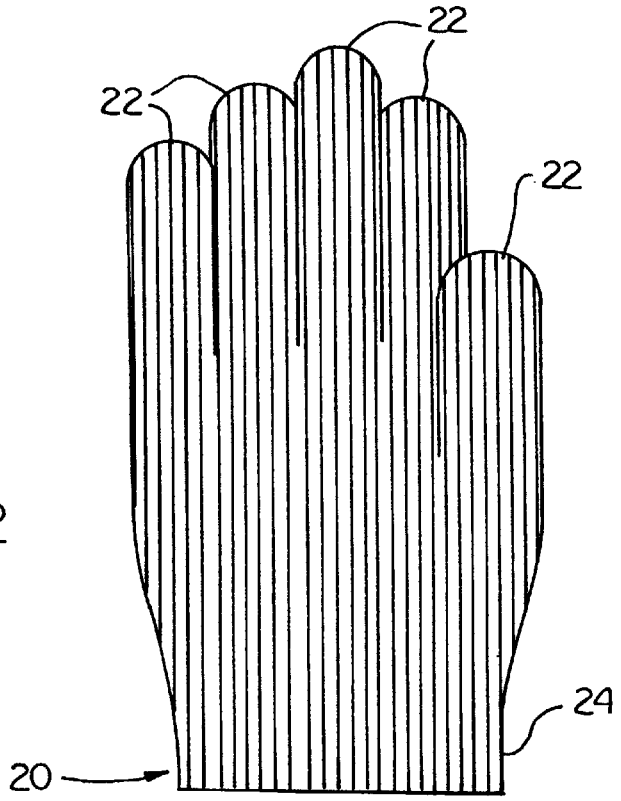
FIG. 2 is an illustration of a glove made according to the present invention.

A knit article constructed according to the present invention, in this case a glove 20, is illustrated in FIG. 2. The glove is constructed according to known glove making techniques and includes 5 finger stalls 22 and a cuff portion 24. The glove cuff 24 typically includes an elastic component to hold the glove securely on the wearer's hand. The yarn depicted in FIG. 1 is fed into the last 5–7 courses of the cuff as the glove is knitted. Suitable glove making machines for this purpose include those available from Shima Seiki. After knitting, the glove is then subjected to a heat setting treatment that causes the melting of the low melt yarn and thus locks the strands in the last several courses of the knit glove in place. Known machines for this step include those available from Shima Seiki and Matsushita Electrical Industrial Company. Machines from the latter company are available under the brand name VIKENAGA.

The above-described advantages illustrate only a few of the benefits of the present invention. Other advantages, not listed here, will be readily apparent to one of ordinary skill and are included in the scope of the present invention.

Although the present invention has been described with preferred embodiments, it is to be understood that modifications and variations may be utilized without departing from the spirit and scope of this invention, as those skilled in the art will readily understand. Such modifications and variations are not discussed here for the purpose of brevity and clarity but are considered to be within the purview and scope of the appended claims and their equivalents.

What we claim is:

1. A knit article having an edge portion subject to raveling, the article, comprising:

a. a plurality of knitting courses in said edge portion; and b. wherein each of said edge portion knitting courses is knitted with a composite heat fusible yarn, the heat fusible yarn comprising i. a core including at least one low melt core strand;

ii. at least one cover strand wrapped around said core in a first direction; and iii. wherein said at least one cover strand is wrapped around said core at a rate suitable to partially cover said core while leaving exposed a sufficient amount of said core to facilitate a bond to an adjacent yarn strand in a knit structure upon application of heat to said core.

2. A knit article according to claim 1 further comprising an additional cover strand wrapped about said at least one cover strand in a second direction opposite to that of said first cover strand.

3. A knit article according to claim 1 wherein said at least one cover strand is wrapped about said low melt core at a rate of up to about 20 turns per inch.

4. A knit article according to claim 1 wherein said at least one cover strand is wrapped about said low melt core at a rate of between about 3 and about 10 turns per inch.

5. A knit article according to claim 1 wherein said at least one cover strand is wrapped about said low melt core at a rate of about 5 turns per inch.

6. A knit article according to claim 1 wherein said low melt core is comprised of a material selected from the group consisting of polyethylene, polyethylene copolymers, polypropylene and polyamide.

7. A knit article according to claim 1 wherein said low melt core strand has a denier between about 50 and about 300.

8. A knit article according to claim 1 wherein said low melt core strand has a denier between about 175 and about 250.

9. A knit article according to claim 1 wherein said first cover strand is comprised of a material selected from the group consisting of nylon, polyester, polyester cotton blend, cotton, wool and acrylic.

10. A knit glove having a cuff portion subject to raveling, the glove comprising:

a. a plurality of knitting courses in an edge portion of said cuff portion; and b. wherein each of said edge portion knitting courses is knitted with a composite heat fusible yarn, the composite heat fusible yarn comprising i. a core including at least one low melt core strand;

ii. at least one cover strand wrapped about said core in a first direction; and iii. wherein said at least one cover strand is wrapped around said core at a rate suitable to partially cover said core while leaving exposed a sufficient amount of said core to facilitate a bond to an adjacent yarn strand in a knit structure upon application of heat to said core.

11. A knit glove according to claim 10 wherein said at least one low melt core strand is comprised of a material selected from the group consisting of polyethylene, polyethylene copolymers, polypropylene, and polyamide.

12. A knit glove according to claim 10 wherein said at least one cover strand is comprised of a material selected from the group consisting of nylon, polyester, polyester cotton blend, cotton, wool and acrylic.

13. A heat fusible composite yarn comprising:

(a) a low melt core comprised of at least one low melt core strand;

(b) at least one cover strand wrapped around said core in a first direction; and (c) wherein said at least one cover strand is wrapped around said core at a rate suitable to partially cover said core while leaving exposed a sufficient amount of said core to facilitate a bond to an adjacent yarn strand in a knit structure upon application of heat to said core.

14. A heat fusible composite yarn according to claim 13 further comprising an additional cover strand wrapped around said at least one cover strand in a second direction opposite to said first direction.

15. A heat fusible composite yarn according to claim 13 wherein low melt core is comprised of a material selected from the group consisting of polyethylene, polyethylene copolymers, polypropylene and polyamide.

16. A heat fusible composite yarn according to claim 13 wherein said at least one cover strand is comprised of a material selected from the group consisting of nylon, polyester, polyester cotton blend, cotton, wool and acrylic.

17. A heat fusible composite yarn according to claim 13 wherein said low melt core is comprised of at least two low melt strands.

18. A heat fusible composite yarn according to claim 13 wherein said at least one cover strand is wrapped about said low melt core at a rate of no more than about 20 turns per inch.

19. A heat fusible composite yarn according to claim 13 wherein said at least one cover strand is wrapped about said low melt core at a rate of between about 3 and about 10 turns per inch.

20. A heat fusible composite yarn according to claim 13 wherein said at least one cover strand is wrapped about said low melt core at a rate of between about 5 turns per inch.

21. A knit article according to claim 13 wherein said low melt core has an overall denier of between about 50 and about 300.

22. A knit article according to claim 13 wherein said low melt core has an overall denier of between about 175 and about 250.

23. A heat fusible composite yarn comprising:

(a) a core comprised of at least one low melt core strand;

(b) wherein said core strand is comprised of a material selected from the group consisting of polyethylene, polyethylene copolymers, polypropylene and polyamide;

(d) at least one cover strand wrapped around said core strand;

(e) wherein said at least one cover strand is wrapped around said at least one core strand at a rate suitable to partially cover said core strand while leaving exposed a sufficient amount of said at least one low melt core strand to facilitate a bond to an adjacent yarn strand in a knit structure upon application of heat to said at least one low melt core strand; and (f) wherein said at least one cover strand is comprised of a material selected from the group consisting of nylon, polyester, polyester cotton blend, cotton, wool and acrylic.

* * * * *